United States Patent [19]

Newton et al.

[11] 4,069,528

[45] Jan. 24, 1978

[54] DART-POINT SHARPENER AND STRAIGHTENING DEVICE

[76] Inventors: Milton Dwayne Newton, 12113 Beverly Blvd. Q, Whittier, Calif. 90601; Leo Gaston Willette, 1911 Robinson St., Redondo Beach, Calif. 90278

[21] Appl. No.: 704,623

[22] Filed: July 12, 1976

[51] Int. Cl.[2] ..... B25F 1/00

[52] U.S. Cl. ..... 7/1 R; 51/181 R; 140/147

[58] Field of Search ..... 51/181 R, 181 NT, 204, 51/211 R, 214, 5 A; 72/319; 76/88; 140/147, 149; 7/1 R, 1 H; 273/106.5 R; 145/27

[56] References Cited

U.S. PATENT DOCUMENTS

| | | | |
|---|---|---|---|
| 70,529 | 11/1867 | Collier | 140/147 |
| 201,115 | 3/1878 | Lombard | 51/204 |
| 1,259,136 | 3/1918 | Rogers | 145/27 |
| 2,465,442 | 3/1949 | Gaylor | 51/204 X |
| 2,696,746 | 12/1954 | Hoffman | 140/147 X |
| 2,723,508 | 11/1955 | Haworth | 51/204 |
| 3,989,079 | 11/1976 | Treadway | 145/27 |

*Primary Examiner*—Gary L. Smith
*Attorney, Agent, or Firm*—Francis X. LoJacono

[57] ABSTRACT

A device for sharpening and straightening the pointed tip of a dart of the type used in game play, wherein the device comprises an elongated tubular housing having a sharpening end and a point-straightening end, the central bore of the housing being adapted to receive a sharpening body member held in place by an end cap forceably secured in an enlarged counter bore, the cap having a central aperture aligned with the conical bore disposed within the sharpening body member, the dull point of the tip being positioned within the conical bore and rotated therein, causing a new point to be formed thereon. The straightening end includes a plug fixedly disposed therein having a conical cavity which allows the bent tip of a dart to be inserted and bent back to a straight position.

6 Claims, 6 Drawing Figures

FIG. 1
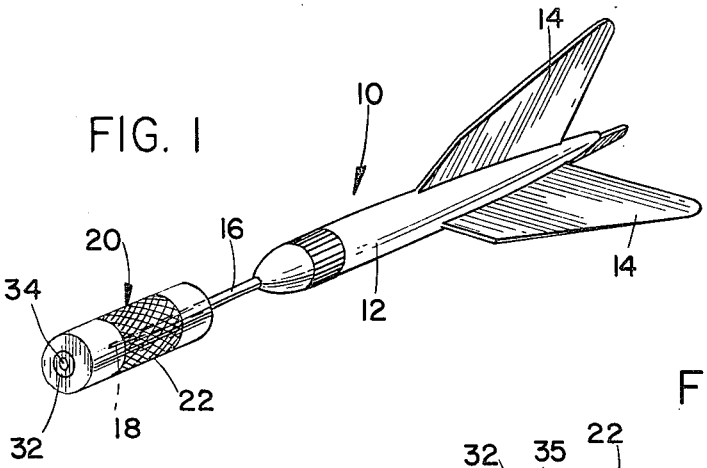
FIG. 2
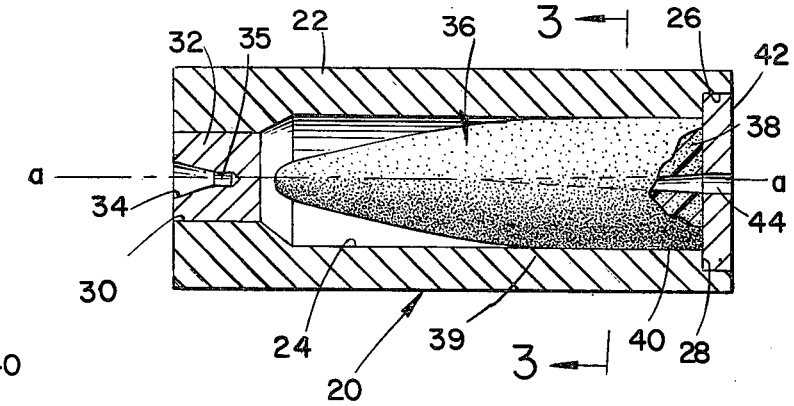
FIG. 3
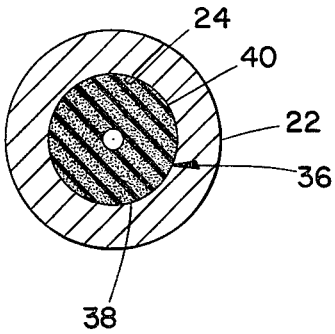
FIG. 4
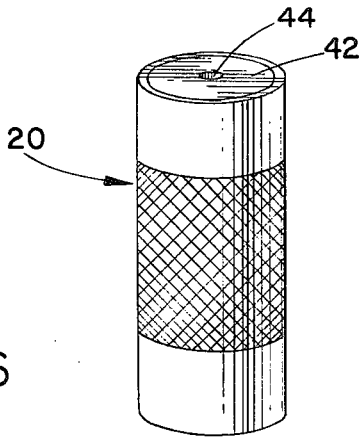
FIG. 5
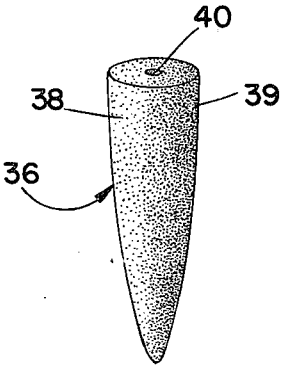
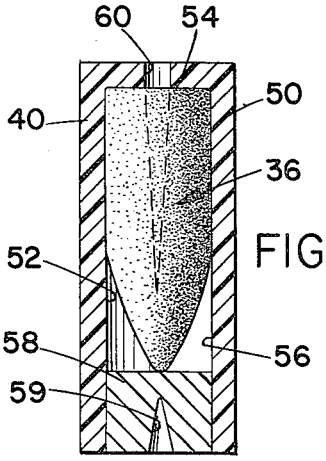
FIG. 6

DART-POINT SHARPENER AND STRAIGHTENING DEVICE

BACKGROUND

1. Field of the Invention

This invention relates to a sharpening device and, more particularly, to a device for straightening and sharpening dull ends of throwing darts.

2. Description of the Prior Art

As is well known in the art, several problems and difficulties are encountered in providing suitable means for re-sharpening the dull points of darts, and also to provide a means to straighten bent points prior to sharpening thereof.

Various types of sharpening devices are used such as metal files and the like, and sharpening stones. However, these are not very satisfactory because points are not consistently and uniformly formed. That is, one must become very proficient when using the above-mentioned sharpening tools in order to provide a balanced tip that is sharpened in a concentric manner.

Further, if the tip end is bent in addition to being dull, the tip should be straightened first before it is sharpened. When a bent tip is not straightened further problems will occur — not only with respect to the dart, but also resulting in damage to a sharpening stone.

Thus, there is a need for a simple device that will allow any individual to straighten and sharpen each dart point in a professional manner each time it is used.

SUMMARY

The present invention comprises a device for straightening and sharpening dull points of throwing darts of the type used in games where the dart is thrown at a dart board.

The device is formed by an elongated housing having a central bore adapted to receive a sharpening element therein. The sharpening element comprises a body that is force fitted into the housing bore, the body being formed from a pliable rubber or simulated rubber plastic material having metal particles dispersed throughout the material thereof.

Included and centrally disposed within the body member is a conical bore which is aligned with an aperture formed in the cap member that is fixedly received in an enlarged counter bore of the housing. This then estabilishes the sharpening end of the device.

The opposite end of the device is provided with an additional bore in which a plug is inserted therein. The plug has a conical recess or cavity in which the bent end of the dart is received and manipulated therein to straighten the point thereof prior to sharpening. Accordingly, the above defines the point straightening end of the device.

OBJECTS AND ADVANTAGES

The present invention has for an important object a provision wherein needle-like points can be straightened and re-sharpened to their original shape.

It is another object of the invention to provide a dart-point straightening and sharpening device that is particularly designed for use with the well known dart employed in various games having a dart board.

It is still another object of the invention to provide a dart-straightening and sharpening device that includes a simple sharpening element disposed within a small elongated housing, wherein the point end of the dart can be readily engaged therewith.

It is a further object of the present invention to provide a dart-straightening and sharpening device that includes in one end thereof a straightening plug member.

It is still a further object of the invention to provide a device of this character that is easy to operate, and wherein the dart tip is always formed in an identical manner each time the device is used.

Still another object of the invention is to provide a device of this character that is relatively inexpensive to manufacture.

It is still a further object of the invention to provide a sharpening device of this character that is simple and rugged in construction.

Other characteristics, advantages and objects of this invention can be more readily appreciated from the following description and appended claims. When taken in conjunction with the accompanying drawings, this description forms a part of the specification wherein like references and characters designate corresponding parts in several views which are as follows.

BRIEF DESCRIPTION OF THE DRAWINGS

Referring more particularly to the accompanying drawings, which are for illustrative purposes only:

FIG. 1 is a perspective view of the present invention showing a dart being received in the sharpening end thereof;

FIG. 2 is an enlarged longitudinal cross section of the device showing the position of the sharpening and straightening elements disposed therein;

FIG. 3 is a cross-sectional view taken along line 3—3 of FIG. 2;

FIG. 4 is a perspective view of the device illustrating the sharpening end thereof; and FIG. 5 is a perspective view of the sharpening element.

DESCRIPTION OF THE PREFERRED EMBODIMENT

Referring more particularly to FIG. 1, there is shown a throwing dart, generally indicated at 10. As is well known in the art, dart 10 is used with various dart game boards and comprises a main tapered body 12 having tail guide means 14 and an elongated pointed metal pin 16.

During game play, the point 18 of the dart 10 will become worn and dull, and must be sharpened to provide an effective device. Further, it sometimes happens that the dart hits an object other than the intended game board. This not only dulls the point 18, but bends said point out of shape.

Thus, the present invention of a dart-point straightening and sharpening device, generally indicated at 20, is necessary to maintain a workable and useable dart. The device comprises an elongated housing 22 having an elongated bore 24 centrally disposed therein along a longitudinal axis *a—a*. The bore terminates at one end thereof with an enlarged counter-bore 26, providing an annular shoulder 28. This end will be hereinafter referred to as the "sharpening" end, the opposite end of the housing will be referred to as the "straightening" end.

The straightening end includes a reduced diameter bore 30 adapted to fixedly receive a plug member 32, which forms the straightening means for the point of the dart. The plug member 32 includes a conical shaped recess 34 with a small extended cavity 35 formed therein.

When the bent point of the dart is positioned within the recess 34 and cavity 35, the dart is then manipulated to straighten the point. The manipulation thereof will depend on the condition of the point.

After the point 18 has been straightened, it is then ready to be sharpened. Thus, there is included a sharpening means, designated generally at 36, which is adapted to be received in the central elongated bore 24 of the housing 22, as seen in FIG. 2. Said sharpening means may take any suitable form but is shown herein as having a bullet-like configuration comprising an abrasive body 38 of rubber or plastic material impregnated with metal particles 39. These particles provide the means to re-shape the point 18 as it is rotated in a back-and-forth movement within an elongated conically-tapered bore 40.

After the abrasive body 38 is positioned within bore 24, a cap member 42 is fixedly mounted within counterbore 26 against the annular shoulder 28. Said cap includes a central aperture 44 which is aligned with said tapered bore 40. Aperture 44 also allows the dart pin 16 to be longitudinally aligned along axis *a—a* to provide a perfectly-shaped point.

It is contemplated that cap 42 can be removed when necessary, whereby the abrasive body 38 can be replaced when required.

Referring now to FIG. 6, there is shown an alternative arrangement of the present invention wherein the housing 50 is constructed of a hard plastic material defining a cylinder having an elongated bore 52. The bore terminates at one end with top wall 54 of the housing 50 which forms the cap thereof; and the opposite end thereof terminates with an opened end 56 in which a point straightening means 58 is fixedly secured therein, said straightening means being identical to plug member 32 as previously decribed, wherein a conical recess 59 is centrally disposed therein to receive a bent point.

Prior to securing plug 58 in bore 52, sharpening means 36 is inserted therein with point-sharpening bore 40 being centrally aligned with aperture 60 that is formed in top wall 54 of housing 50.

Thus, in this arrangement there is one less part to be assembled — that being top wall 54.

The invention and its attendant advantages will be understood from the foregoing description; and it will be apparent that various changes may be made in the form, construction and arrangement of the parts of the invention without departing from the spirit and scope thereof or sacrificing its m

We claim:

1. A dart-point straightening and sharpening device comprising:

an elongated housing having an elongated longitudinal bore;

an abrasive sharpening means arranged to be disposed within said longitudinal bore;

a cap fixedly mounted to one end of said housing and having an aperture centrally disposed therein to receive the point of a dart therethrough to engage said sharpening means; and a point-straightening means mounted to the housing end opposite the end used for sharpening said dart point, and wherein said housing includes:

an enlarged bore adjacent the one end of said longitudinal bore formed to receive said cap therein; and a reduced-diameter bore disposed at the opposite end of said housing wherein said straightening means is affixedly mounted therein.

2. A dart-point straightening and sharpening device as recited in claim 1, wherein said abrasive sharpening means comprises an abrasive body formed to be received in said longitudinal bore of said housing, having a central conically tapered bore aligned with said aperture of said cap.

3. A dart-point straightening and sharpening device as recited in claim 2, wherein said point straightening means comprises a plug member having a conical recess disposed therein, and an extended cavity to receive a bent point therein whereby the point can be manipulated therein to straighten said point.

4. A dart-point straightening and sharpening device as recited in claim 3, wherein said abrasive body comprises:

a rubberized plastic material; and abrasive particles impregnated within said material, said particles being evenly dispersed throughout said material.

5. A dart-point straightening and sharpening device as recited in claim 4, wherein said cap is formed as an integral part of said housing.

6. A dart-point straightening and sharpening device as recited in claim 4, wherein said abrasive body includes a bullet-like configuration so as to be readily and removably received in said housing bore.

* * * * *